United States Patent [19]

Kukes et al.

[11] Patent Number: 4,464,251

[45] Date of Patent: Aug. 7, 1984

[54] REMOVAL OF CONTAMINANTS FROM ORGANIC COMPOSITIONS

[75] Inventors: Semyon G. Kukes; Jesse R. Harris; Robert L. Banks, all of Bartlesville, Okla.

[73] Assignee: Phillips Petroleum Company, Bartlesville, Okla.

[21] Appl. No.: 457,341

[22] Filed: Jan. 12, 1983

[51] Int. Cl.[3] ..... C10G 17/08; C10G 21/08; C10G 21/16; C10G 21/24

[52] U.S. Cl. ..... 208/221; 208/208 R; 208/238; 208/240; 208/251 R; 208/254 R

[58] Field of Search ..... 208/208 R, 251 R, 254 R, 208/292, 238, 221, 240

[56] References Cited

U.S. PATENT DOCUMENTS

| | | | |
|---|---|---|---|
| 2,176,884 | 10/1939 | Butz et al. | 208/292 |
| 2,780,582 | 2/1957 | Junk, Jr. et al. | 208/254 R |
| 3,165,462 | 1/1965 | Friedman et al. | 208/86 |
| 4,005,005 | 1/1977 | McCollum et al. | 208/11 LE |
| 4,159,940 | 7/1979 | Smith | 208/254 H |

*Primary Examiner*—Delbert E. Gantz
*Assistant Examiner*—O. Chaudhuri
*Attorney, Agent, or Firm*—French, Hughes and Doescher

[57] ABSTRACT

Metals, nitrogen and/or sulfur, particularly vanadium, nickel and nitrogen, are removed from organic compositions, particularly heavy hydrocarbon oils, by contacting the organic compositions with a halogenating agent, preferably phosphorus oxychloride, under conditions sufficient to form a distinct phase including the contaminants, which is separable from the organic composition and separating the distinct phase from the organic composition as by filtration, decantation, and the like. In another embodiment of the present invention, the treatment with the halogenating agent is carried out in conjunction with treatment with an acid gas and water, as a combination of carbon dioxide and water, or a solvent.

13 Claims, No Drawings

REMOVAL OF CONTAMINANTS FROM ORGANIC COMPOSITIONS

BACKGROUND OF THE INVENTION

The present invention relates to the removal of metal, nitrogen and/or sulfur contaminants from organic compositions. More specifically, the present invention relates to the removal of metal, nitrogen, and/or sulfur contaminants from organic compositions by the use of halogenating agents.

It is known that many organic compositions, particularly hydrocarbons such as crude oil, contain at least small amounts of a contaminating metals, sulfur and nitrogen which are detrimental, particularly in the processing of such materials to produce commercially valuable products. In the recent past, light crude oils have been available in sufficient quantities to permit their use almost exclusively for the production of commercially valuable products such as gasoline, fuel oils, and feedstocks for petrochemical production. Such oils contain very small amounts of metallic contaminants and nitrogen. Therefore, the only contaminant of any significance was sulfur. However, the sulfur is present in such oils in relatively small amounts and in a form which can be readily removed by techniques such as hydrogenation. The current shortage of light, sweet crude oils has substantially increased the necessity of utilizing heavier crude oils as well as oils produced from coal and lignite, tar sands, shale and the like and will undoubtedly increase rapidly in the future. By contrast to light crude oils, such heavy oils and synthetic oils contain substantially larger amounts of sulfur in more complex and difficult to remove forms, substantial amounts of nitrogen compounds, also in a difficult to remove form, as well as significant amounts of metals, such as vanadium and nickel. The sulfur and nitrogen not only form acidic compounds which are detrimental in further processing but produce significant amounts of air pollutants when the products are burned as fuels. The presence of metals also makes further processing difficult since the metals generally act as poisons for catalysts employed in processes such as catalytic cracking, hydrogenation, hydrodesulfurization, etc. At the present time, the most prevalent technique for the removal of sulfur and nitrogen is hydrogenation. However, the removal of sulfur requires substantially larger amounts of hydrogen and more severe conditions than previously utilized and the removal of nitrogen requires still higher volumes of hydrogen and more severe conditions. The necessity of utilizing substantial amounts of hydrogen also creates a problem not heretofore encountered. In most refinery operations, a catalytic reforming unit exists which has a net production of hydrogen. In the past, the hydrogen produced by a catalytic reforming unit has been sufficient to supply all of the hydrogen needs of the refinery. However, where the heavier feed materials, which are highly contaminated, are to be processed this is no longer the case and additional hydrogen must be produced by other means such as methane reforming, etc. In the past, there has been no particularly effective and economical means of removing metallic contaminants from the crude oils, etc. Instead, the problems created by the presence of such metals have been essentially neutralized during catalytic treating operations such as hydrocracking by techniques such as metal passivation. In any event, the seriousness of the above mentioned problems requires that some technique be available for the removal of such contaminants and the removal of even small amounts prior to or during processing would be highly advantageous.

SUMMARY OF THE INVENTION

It is therefore an object of the present invention to provide an improved process for treating organic compositions which overcomes the above and other problems of the prior art. Another object of the present invention is to provide an improved process for treating organic compositions which improves subsequent processability thereof. Yet another object of the present invention is to provide an improved technique for treating organic compositions which reduces pollution resulting from the burning of fuels derived from such organic compositions. Another and further object of the present invention is to provide an improved technique for the removal of metal, nitrogen and/or sulfur contaminants from organic compositions. A still further object of the present invention is to provide an improved technique for the removal of metal, nitrogen and/or sulfur contaminants from crude oils and synthetic oils. A further object of the present invention is to provide an improved technique for the removal of metal, nitrogen and/or sulfur contaminants from organic compositions which is relatively inexpensive. Another object of the present invention is to provide an improved technique for the removal of metal, nitrogen and/or sulfur contaminants from organic compositions which is relatively simple to operate. Another object of the present invention is to provide an improved process for the removal of metal, nitrogen and/or sulfur contaminants from organic compositions in conjunction with other solvents and/or extractants. A further object of the present invention is to provide an improved technique for the removal of metal, nitrogen and/or sulfur contaminants from organic compositions which results in synergistic action in conjunction with other solvents and extractants. These and other objects of the present invention will be apparent from the following description of the invention.

In accordance with the present invention, it has been found that organic compositions and particularly crude oils and synthetic oils can be treated in a simple and economic manner to improve the processability thereof and reduce the production of pollutants in the burning of the fuels derived therefrom by contacting the organic composition with an halogenating agent, for example, phosphorous oxychloride, to form a distinct phase, including the contaminants, and separating the distinct phase from the organic composition.

In another aspect of the present invention, it has been found that the above mentioned halogenating agents act synergistically in conjunction with diluents and/or solvents such as toluene and/or other extractants such as acidic gases, for example, carbon dioxide.

DESCRIPTION OF THE PREFERRED EMBODIMENTS

In accordance with the present invention, organic compositions are treated with a halogenating agent which forms a distinct phase, usually a precipitate of metal contaminants particularly nickel and vanadium, nitrogen contaminants and also some sulfur compounds and the distinct phase is thereafter separated from the organic composition.

Organic compositions which can be effectively treated in accordance with the present invention include crude oils, particularly heavy crude oils, products from the extraction and/or liquefaction of coal and lignite, products from the extraction of tar sands, products from the extraction and/or liquefaction of shale and similar synthetic oils.

It is known that anywhere from 40 to 70 percent of metals, such as nickel and vanadium and other contaminants, are present in crude oils and synthetic oils in the form of porphyrins. While it is not intended that the present invention be restricted to any particular theory, it is believed that the halogenating agents combine with metalloporphyrins, asphaltenes and/or other complex structures containing metal, nitrogen and/or sulfur contaminants to form a precipitate or at the least a distinct separable phase which can then be removed from the treated oil. Such combination is also believed to be the result of the halogenating agent having strong chelating properties.

Specifically, in accordance with the present invention, the halogenating agent has the following formula:

$$R_nP(X)Y_{x-n}$$

Where R is selected from the group consisting of an alkyl group and an alkoxy group having from one to six carbon atoms, and a phenyl group and a phenoxy group; X is selected from the group consisting of oxygen and sulfur; Y is a halogen; n is 0 to 2 and x is 3.

Preferably, X is oxygen.

Preferably, Y is a halogen selected from the group consisting of chlorine and bromine and, still more preferably, Y is chlorine.

Preferably, n is 0, X is oxygen, Y is chlorine and x is 3 resulting in a particularly preferred material phosphorus oxychloride.

Treating in accordance with the present invention may be carried out in any convenient manner either batchwise or continuously. Preferably, refluxing is employed. Likewise, treatment can be carried out in any known type of reactor such as a cascade, tray, scrubber or countercurrent reactor.

Suitable amounts of halogenating agent will depend upon the nature and content of contaminants in the organic material, the nature of the organic material, etc. However, the amounts of halogenating agent may range from about 0.01 to about 50 percent by weight based on the weight of the organic material being treated, preferably between about 0.05 and 10 percent by weight of the organic material being treated.

Temperatures of treatment can be anywhere from atmospheric to about 550° C. or higher, preferably between about 100° and about 550° C.

Pressures may also range from atmospheric to about 5,000 psig, preferably between about 100 to 2,500 psig.

Contact times may also vary quite widely again depending upon the nature and content of the contaminants and the organic material being treated. However, a suitable range would be between about 0.01 and about 100 hours, preferably between about 0.1 and 10 hours.

Where the organic material to be treated is a highly viscous material, it is preferably diluted with a known diluent in order to reduce the viscosity. Such diluents include aromatic hydrocarbons, such as toluene, aliphatic hydrocarbons, such as hexane, heptane and the like and similar diluents. It has been found in accordance with the present invention that further improvement can be obtained when the halogenating agent is utilized in conjunction with the use of a diluent or solvent and it appears in accordance with the tests of the present invention, that some synergistic action occurs. Diluents and solvents may be utilized in any suitable amount but preferably they are utilized in a ratio of about 0.5 volume per volume of organic material being treated to 5:1 or higher, preferably however, ratios of 1:1 to 5:1 are preferred. The diluent or solvent ratio will, of course, depend upon the nature of the organic material and the nature of the diluent or solvent.

While the present invention is quite effective when utilizing the halogenating agent of the present invention in conjunction with diluents or solvents under subcritical conditions, the treatment can also be carried out where the diluent or solvent is under supercritical conditions. Suitable solvents and conditions of operations for such supercritical treatment are generally the same as those utilized in the supercritical extraction of shales and tar sands. Consequently, such solvents and conditions of operation may be the same as those set forth in U.S. Pat. No. 4,108,760, which is incorporated herein by reference.

In accordance with another embodiment of the present invention, it has been found that use of the halogenating agents of the present invention in conjunction with an acidic gas can also be utilized. Tests of the present invention indicate that a synergistic effect is thus obtained. Suitable acidic gases for such purpose include carbon dioxide, hydrogen sulfide, sulfur dioxide, sulfur trioxide, hydrogen cyanide, etc. Carbon dioxide is preferred. Preferably, the acidic gas is utilized in the presence of an immiscible phase, particularly water. For such purposes, the ratio of organic material to water should be from about 0.01 to 5 volumes of organic material per volume of water and preferably between about 0.2 in 2 volumes of organic material per volume of water. The partial pressure of the acid gas can be from about 1 to 100 atmospheres or higher. The remaining operating conditions to be utilized in accordance with this particular embodiment are the same as those previously set forth. This embodiment can also be carried out under supercritical conditions.

The following examples illustrate typical results which were obtained in a laboratory evaluation of the present invention.

In a first series of runs, a Monogas pipeline oil, which contains significant amounts of nickel and vanadium was tested. This crude is a heavy Venezuelan crude which is diluted with a few percent of No. 6 fuel oil to reduce its viscosity so that it can be pumped and transported by pipeline. In all of the tests reported below, the subject, Monogas oil, was utilized.

In a first series of tests, the oil was diluted with heptane in the ratios set forth in Table I below. In both the tests with and without the halogenating agent of the present invention, the samples were refluxed for about three hours at a temperature of about 116° C. The percent by volume of halogenating agent set forth in Table I are based on the total volume of oil and diluent. Table I below reports the results of this series of tests.

TABLE I

| Solvent Oil/Solvent Volume | Agent % by Vol. | Residual Amount Nippm | Vppm | S % | Nppm |
|---|---|---|---|---|---|
| Heptane 1/5 | None | 21.0 | 33.5 | 0.68 | 393 |

TABLE I-continued

| Solvent Oil/Solvent Volume | Agent % by Vol. | Residual Amount Nippm | Vppm | S % | Nppm |
|---|---|---|---|---|---|
| Heptane 1/5 | $POCl_3$ 3% | 11.8 | 9.3 | 0.3 | 68 |
| Heptane 1/5 | None | 51.6 | 197 | 1.99 | 1576 |
| Heptane 1/5 | $POCl_3$ 7% | 36.4 | 76.5 | 1.35 | 629 |
| Heptane 1/5 | None | | | 1.72 | 1303 |
| Heptane 1/5 | $PhP(O)Cl_2$ 4% | | | 1.19 | 884 |
| Heptane 1/5 | None | | | 2.02 | 1476 |
| Heptane 1/5 | $PhP(O)Cl_2$ 6% | | | 1.19 | 1063 |
| Heptane 1/5 | None | | | 0.68 | 393 |
| Heptane 1/5 | $PhP(O)Cl_2$ 3% | | | 0.57 | 61 |

In a second series of tests, toluene was utilized as a solvent. Table II below sets forth the oil/solvent ratio and the halogenating agent/oil ratio and the results obtained in this series of tests.

TABLE II

| Solvent Oil/Solvent Volume | Agent Agent/Oil Volume | Amount Removed Ni % | V % | N % |
|---|---|---|---|---|
| Toulene 2.85/1 | $POCl_3$ 1/37 | 5 | 6 | 38 |
| 2.85/1 | $POCl_3$ 2/37 | 48 | 55 | 16 |
| 2.85/1 | $POCl_3$ 3/37 | 13 | 59 | 35 |
| 2.85/1 | $PhP(O)Cl_2$ 1/37 | 6 | 5 | 40 |
| 2.85.1 | $PhP(O)Cl_2$ 2/37 | 6 | 7 | 29 |
| 2.85/1 | $Ph_2P(O)Cl$ 1/37 | 2 | 6 | 6 |
| 2.85/1 | $Ph_2P(O)Cl$ 1/37 | 4 | 9 | 17 |
| 2.85/1 | $EtP(O)Cl_2$ 1/37 | 0 | 17 | 23 |
| 2.85/1 | $PhP(S)Cl_2$ 1/37 | 0 | 0 | 15 |

Since phosphorus oxychloride was found most effective in the previously reported tests, this agent was compared with carbon dioxide-water, which had been found in parallel work to be an effective combination for removing contaminants from the same Monogas crude oil. In this series of tests, the carbon dioxide-water treatment was carried out by adding water to the oil at an oil-water ratio of about 2 to 1. Thereafter, carbon dioxide was added in an amount sufficient to produce a pressure of about 900 psi. The mixture was then refluxed at a temperature of about 100° F. for periods of 1 to 1.5 hours. In the treatment with phosphorus oxychloride, the agent was simply added in the amounts indicated and refluxing in the same manner was carried out. In the combination tests, the carbon dioxide-water treatment was the same as previously indicated except that the phosphorus oxychloride was added prior to refluxing. Table III below sets forth the results of this series of tests.

| $CO_2$ Press. | Agent % by Vol. | N % Removed | S % Removed | Ni % Removed | V % Removed |
|---|---|---|---|---|---|
| 900 psi | None | 6 | 6 | — | — |
| None | $P(O)Cl_3$ 1.23 | 59 | 10 | — | — |
| 900 psi | $P(O)Cl_3$ 1.23 | 75 | 27 | — | — |
| 900 psi | None | 6 | 6 | — | — |
| None | $P(O)Cl_3$ 2.44 | 68 | 23 | — | — |
| 900 psi | $P(O)Cl_3$ 2.44 | 77 | 31 | — | — |
| 900 psi | None | — | — | 5 | 4 |
| None | $P(O)Cl_3$ 1.23 | — | — | 7 | 17 |
| 900 psi | $P(O)Cl_3$ 1.23 | — | — | 13 | 27 |
| 900 psi | None | — | — | 5 | 4 |
| None | $P(O)Cl_3$ 2.44 | — | — | 5 | 25 |
| 900 psi | $P(O)Cl_3$ 2.44 | — | — | 16 | 20 |

It is to observed from the above that the combination treatment results in significantly improved metal and nitrogen removal as compared with the individual treatments. In addition, it appears that a synergistic effect results from the combination treatment as compared with the sum of the individual treatments. It is believed that the combination treatment can be carried out simultaneously or in any sequence, i.e., halogenation before or after the treatment with the combination of carbon dioxide and water.

It should also be understood in connection with the present invention that the novel halogenation of the present invention can also be carried out in combination with other conventional treating or reaction steps normally applied to the treatment of organic materials, particularly in conjunction with or simultaneously with the hydrogenation of the oil.

While specific modes of operation, materials, amounts of components and the like have been set forth herein, it is to be understood that such specific recitals are for purposes of illustration and setting forth the best mode of operation in accordance with the present invention and are not to be considered limiting.

That which is claimed:

1. A method of removing at least one of metal, nitrogen and sulfur contaminants from an organic composition comprising:

(a) contacting said organic composition with an agent comprising $$R_nP(X)Y_{x-n}$$

where R is selected from the group consisting of an alkyl group and an alkoxy group having from 1 to 6 carbon atoms, a phenyl group and a phenoxy group; X is selected from the group consisting of oxygen and sulfur; Y is a halogen; n is 0 through 2 and x is 3 under conditions sufficient to form a precipitate, including said contaminants;

(b) contacting said organic composition, containing said precipate, with an acid gas in the presence of water under conditions sufficient to form a distinct phase, including said contaminants, which is separable from said organic composition; and (c) separating said distinct phase from said organic composition.

2. A method in accordance with claim 1 wherein steps (a) and (b) are carried out simultaneously.

3. A method in accordance with claim 1 wherein step (a) is carried out before step (b).

4. A method in accordance with claim 1 wherein X is oxygen.

5. A method in accordance with claim 1 wherein Y is a halogen selected from the group consisting of chlorine and bromine.

6. A method in accordance with claim 5 wherein Y is chlorine.

7. A method in accordance with claim 1 wherein the agent is phosphorus oxychloride.

8. A method in accordance with claim 1 wherein the acid gas is carbon dioxide in the presence of water.

9. A method in accordance with claim 1 wherein the organic composition is a hydrocarbon oil.

10. A method in accordance with claim 1 wherein the organic composition is a viscous hydrocarbon oil and a diluent is added thereto in an amount sufficient to reduce the viscosity of said hydrocarbon oil.

11. A method in accordance with claim 1 wherein the organic composition contains vanadium and nickel contaminants and said vanadium and nickel contaminants are removed.

12. A method in accordance with claim 1 wherein the organic composition contains nitrogen contaminants and said nitrogen contaminants are removed.

13. A method in accordance with claim 1 wherein the step of contacting the organic composition with an acid gas is carried out under supercritical conditions of said acid gas.

* * * * *